US006529098B2

(12) United States Patent
Moheb

(10) Patent No.: US 6,529,098 B2
(45) Date of Patent: Mar. 4, 2003

(54) TRANSMITTING AND RECEIVING APPARATUS FOR SATELLITE COMMUNICATION VIA DUAL-POLARIZED SIGNALS

(75) Inventor: Hamid Moheb, Clemmons, NC (US)

(73) Assignee: Prodelin Corporation, Conover, NC (US)

( * ) Notice: Subject to any disclaimer, the term of this patent is extended or adjusted under 35 U.S.C. 154(b) by 0 days.

(21) Appl. No.: 09/797,311

(22) Filed: Mar. 1, 2001

(65) Prior Publication Data

US 2001/0033208 A1 Oct. 25, 2001

Related U.S. Application Data

(60) Provisional application No. 60/186,245, filed on Mar. 1, 2000.

(51) Int. Cl.[7] ..... H01P 1/213

(52) U.S. Cl. ..... 333/135; 333/137; 333/126

(58) Field of Search ..... 333/135, 137, 333/21 A, 126, 248, 208

(56) References Cited

U.S. PATENT DOCUMENTS 3,978,434 A * 8/1976 Morz et al. ..... 333/135
4,251,787 A 2/1981 Young et al.
4,344,048 A * 8/1982 Morz ..... 333/135
4,467,294 A * 8/1984 Janky et al. ..... 333/126
4,491,810 A * 1/1985 Saad ..... 333/126
4,516,089 A * 5/1985 Goscianski et al. ..... 333/135
4,622,524 A * 11/1986 Morz ..... 333/126
4,630,059 A * 12/1986 Morz ..... 333/135
4,777,459 A 10/1988 Hudspeth
5,459,411 A 10/1995 Weber et al.
5,463,407 A 10/1995 West et al.
5,534,881 A 7/1996 Young et al.
5,737,698 A 4/1998 Gabrelian et al.
6,018,276 A 1/2000 Hirota et al.
6,417,815 B2 * 7/2002 Moheb ..... 343/772

* cited by examiner

*Primary Examiner*—Robert Pascal
*Assistant Examiner*—Dean Takaoka
(74) *Attorney, Agent, or Firm*—Alston & Bird LLP

(57) ABSTRACT

A transmitting and receiving apparatus comprises a transmit/receive feed operable to transmit signals to and receive signals from a source, a waveguide assembly coupled with the transmit/receive feed for propagating transmitted and received signals to and from the transmit/receive feed, and a receive isolation filter coupled with the waveguide assembly and operable to filter the dual-polarized received signals without separating the two components thereof and to provide the filtered dual-polarized received signals to a receiver so as to isolate the receiver from signals transmitted by the transmit/receive feed. Thus, both components of the received signals are filtered simultaneously along the same path of propagation, eliminating the need to split the components along separate paths, separately filter them, and then recombine them as in prior antennas.

25 Claims, 3 Drawing Sheets

TRANSMITTING AND RECEIVING APPARATUS FOR SATELLITE COMMUNICATION VIA DUAL-POLARIZED SIGNALS

CROSS-REFERENCE TO RELATED APPLICATIONS

The present invention claims the benefit of the filing date of U.S. Provisional Patent Application Ser. No. 60/186,245 filed Mar. 1, 2000.

FIELD OF THE INVENTION

The present invention relates generally to an antenna for transmitting to and receiving signals from one or more transmitting and receiving sources such as satellites, wherein the received signals are dual-polarized such that they simultaneously contain two components of different polarizations such as two different linearly polarized components on orthogonal planes, or right-hand and left-hand circularly polarized components.

BACKGROUND OF THE INVENTION

In recent years, there has been a significant increase in the amount and types of information that is transmitted via satellite communication. For instance, satellites now transmit telephone signals, television signals, internet data, etc. Due to the expanded use of satellites for data communication, there has also been an associated increase in the number of satellites placed in orbit about the earth. For instance, there are currently satellites that are dedicated to transmission of not only television signals in general, but are dedicated to transmission of only certain types of programming, such as movie channels, foreign language channels, local channel programming, or high definition television signals. Satellites have also been deployed for the transmission of internet signals for some internet providers.

As the use of satellite communications continues to increase, there is a general trend toward more widespread use of satellite antennas by private individuals and commercial and governmental users. For these types of applications, cost and aesthetics are major concerns in the design of antennas. Providing a low cost, compact, and aesthetically pleasing antenna, however, presents design challenges.

One such challenge is reducing the overall size of an antenna while at the same time providing increased functionality required by changes in the way data communications with satellites are conducted. More particularly, there is a trend in satellite communications toward greater and greater utilization of "frequency reuse" so that increasing amounts of information can be transmitted and received within a given frequency band. Frequency reuse refers to a method of increasing the throughput of information in a frequency band by dual-polarizing a transmitted signal such that the signal contains two components of different polarizations. For instance, two components can be linearly polarized in two different planes, typically orthogonal to each other and usually referred to as "vertical" and "horizontal" planes. Alternatively, both right-hand and left-hand circularly polarized components can be contained in the same signal. In either case, each component is encoded with information, such that about half of the transmitted information is carried in one polarization component and the other half is carried in the other polarization component. Traditionally, in the satellite antenna industry, such dual-polarized signals containing vertical and horizontal linearly polarized components have been received by a transmit/receive (T/R) feed and passed through an ortho-mode transducer (OMT), which is essentially a Y junction that channels transmitted signals from a transmitter of the antenna to the T/R feed, and channels received signals received by the T/R feed to a receive side of the antenna. The receive side of the antenna traditionally has included a diplexer for separating the vertical polarization component of the received signal from the horizontal component thereof. Downstream of the diplexer, a pair of rectangular waveguide/filter elements have traditionally been used for separately filtering the vertical and horizontal components of the received signal so as to prevent signals transmitted by the transmitter of the antenna from propagating down the receive side of the antenna to the antenna's receiver. After the vertical and horizontal components are separately filtered, they are typically recombined in a recombiner, and are then passed to further electronics for processing before being passed to the antenna's receiver. Thus, the conventional antenna capable of handling dual-polarized signals has required a diplexer, two separate filter elements, and a recombiner. All of these components can add to the cost and overall size of the antenna.

SUMMARY OF THE INVENTION

The present invention addresses the above-noted needs by providing an apparatus for receiving signals from and transmitting signals to a source such as a satellite, in which the traditionally used diplexer, separate vertical and horizontal filters, and recombiner are replaced by a considerably simplified system for handling dual-polarized received signals. In accordance with one preferred embodiment of the invention, the apparatus comprises a transmit/receive feed operable to transmit signals to and receive signals from a source, a waveguide assembly coupled with the transmit/receive feed for propagating transmitted and received signals to and from the transmit/receive feed, and a receive isolation filter coupled with the waveguide assembly and operable to filter the dual-polarized received signals without separating the two components thereof and to provide the filtered dual-polarized received signals to a receiver so as to isolate the receiver from signals transmitted by the transmit/receive feed. Thus, both components of the received signals are filtered simultaneously along the same path of propagation, eliminating the need to split the components along separate paths, separately filter them, and then recombine them as in prior antennas. The receive isolation filter, also referred to herein as a dual-mode filter, can filter signals containing two orthogonal linearly polarized components, and can also filter signals containing right-hand and left-hand circularly polarized signals.

The apparatus in accordance with the invention preferably forms a part of an antenna for receiving signals from and transmitting signals to a satellite. In a preferred embodiment, the receive isolation filter defines multiple internal cavities of different dimensions. In order to simultaneously filter two orthogonal components of the dual-polarized received signals, the receive isolation filter preferably defines an internal waveguide passage that has 90° rotational symmetry about its longitudinal axis. By "90° rotational symmetry" is meant that a cross-section through the passage along a first plane, such as the plane of one of the polarization components and containing the longitudinal axis of the passage, is substantially identical to a cross-section through the passage along a second plane orthogonal the first plane and also containing the longitudinal axis. Thus, the passage appears the same to each of the polarization components, whether the components comprise two orthogonal linearly polarized components or right-hand and left-hand circularly polarized components. In other words, the filter is polarization-independent. Various internal cross-sectional shapes having such 90° rotational symmetry can be used for the filter, including but not limited to circular cylindrical passages or square passages. In a preferred embodiment, the receive isolation filter has a circular internal cross-section. More particularly, in a preferred embodiment the receive isolation filter comprises a plurality of sequentially arranged circular cylindrical cavities of different internal diameters and volumes.

The apparatus can be incorporated in an antenna for communications with two different sources such that the antenna transmits to and receives from a first source and only receives from a second source. In this case, the apparatus also includes a second feed operable to receive signals from the second source, and a second receive isolation filter operable to filter the received signals from the second feed so as to isolate the antenna's receiver from signals transmitted by the transmit/receive feed. Of course, if the signals received by the second feed are dual-polarized signals, then the second receive isolation filter can be a dual-mode filter similar in concept to that used with the transmit/receive feed.

Antennas in accordance with the invention can also include additional feeds for communicating with additional sources such as satellites, if desired.

The invention thus simplifies the design and manufacturing of an antenna for satellite communications via dual-polarized signals, and enables the filtering and waveguide elements of the antenna to be made more compact in size and lower in cost compared with prior antennas employing separate filtering of the two components of the dual-polarized signals.

BRIEF DESCRIPTION OF THE DRAWINGS

The above and other objects, features, and advantages of the invention will become more apparent from the following description of certain preferred embodiments thereof, when taken in conjunction with the accompanying drawings in which.

DETAILED DESCRIPTION OF THE INVENTION

The present invention now will be described more filly hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
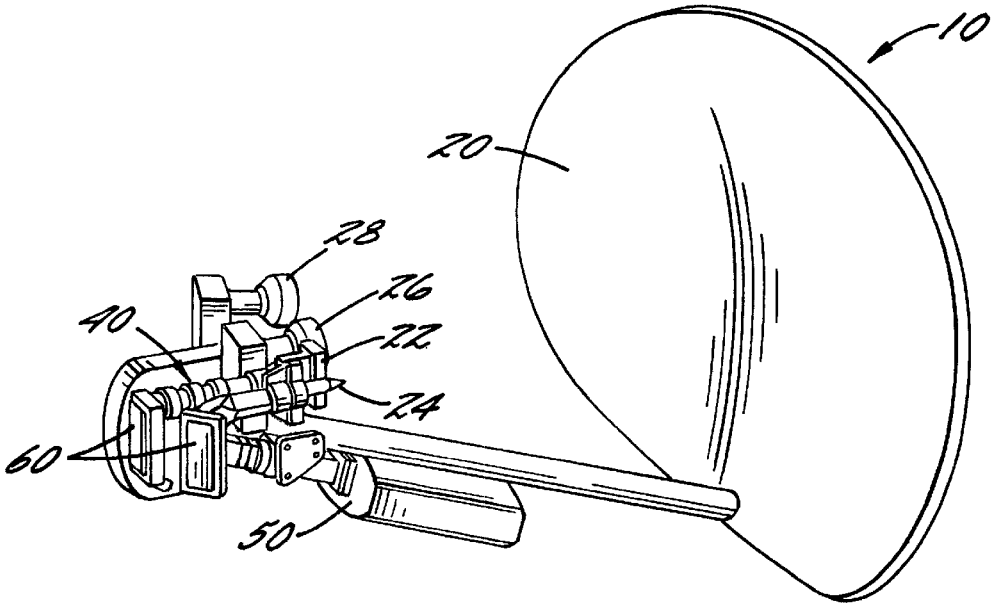
FIG. 1 is a perspective view of an antenna in accordance with one embodiment of the invention.

FIG. 1 shows an antenna 10 in accordance with one preferred embodiment of the invention. The antenna 10 includes a reflector 20 that has a concave shape for reflecting signals inbound from a transmitting source such as a satellite such that the reflected signals are focused at a focal point spaced from the concave surface of the reflector. Located at or in close proximity to the focal point of the reflector are a transmit/receive (T/R) feed 22 and a plurality of additional feeds 24, 26, and 28. The feed 24 in this particular embodiment comprises a receive feed that receives signals but is not designed to transmit signals. The TIR feed 22 advantageously comprises a corrugated feed.

Figure 2:
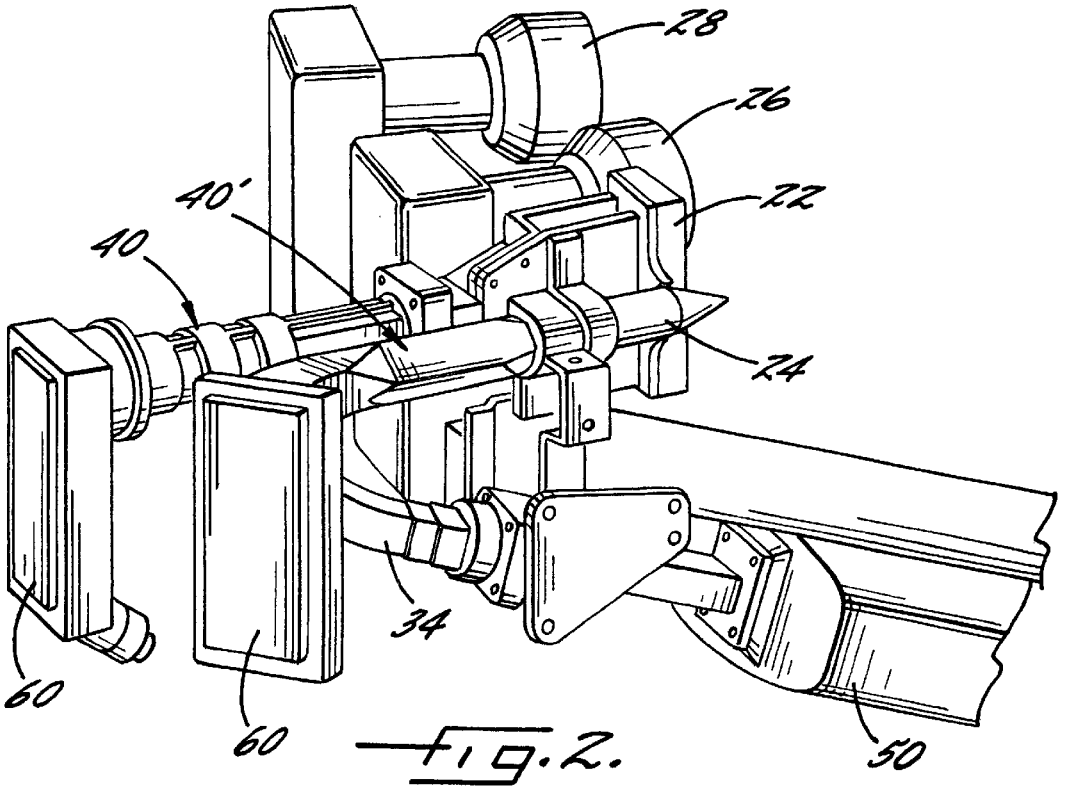
FIG. 2 is a perspective view of an assembly of the antenna including feeds, waveguide elements, filtering elements, and other components.
Figure 3:
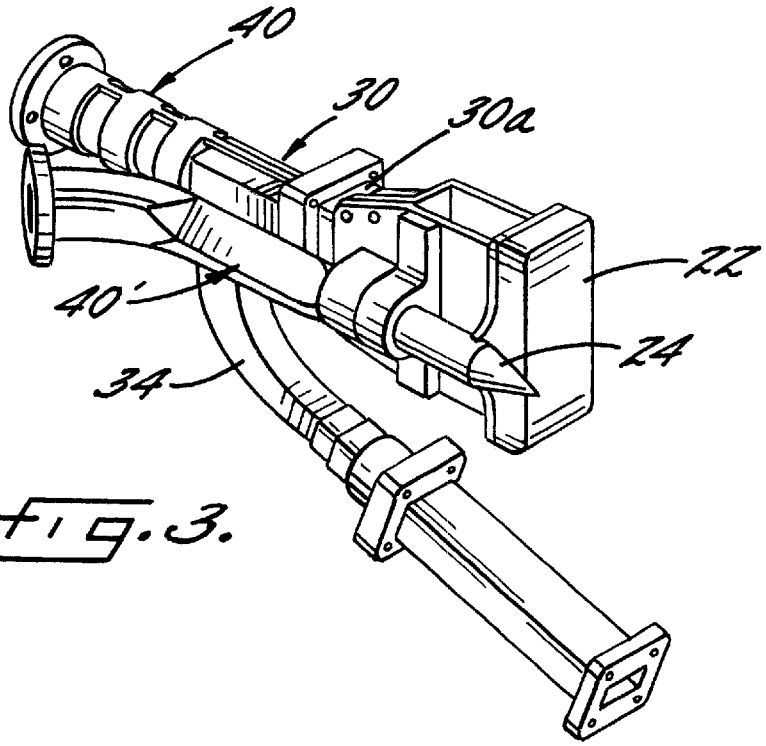
FIG. 3 is a perspective view of a portion of the assembly of FIG. 2.
Figure 4:
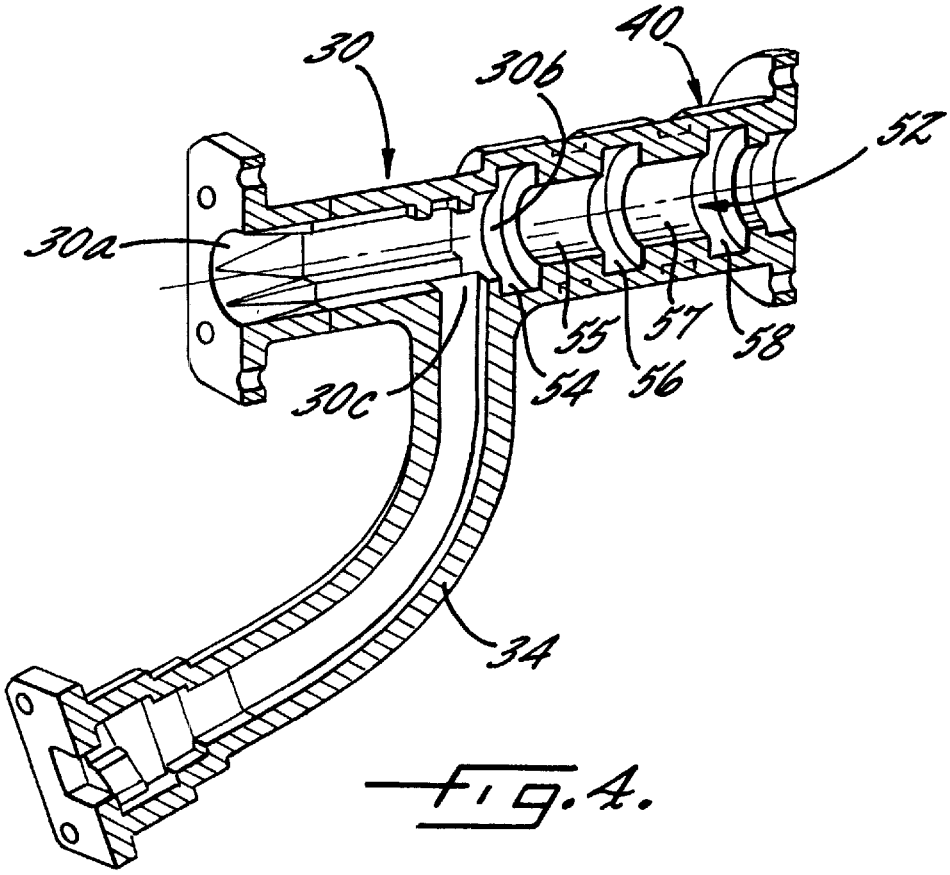
FIG. 4 is a sectioned view, in perspective, of a receive isolation filter in accordance with an embodiment of the invention.

With reference to FIGS. 2–4, the feeds 22 and 24 and associated components are shown in greater detail. The T/R feed 22 receives signals transmitted by a source and reflected from the reflector of the antenna, and directs the received signals via a waveguide assembly to farther components of the antenna. More particularly, the feed 22 directs the received signals into a main port 30*a* (FIG. 4) of a Y junction device 30, such as an ortho-mode transducer. The Y junction device 30 includes a receive outlet port 30*b* to which is coupled a receive isolation filter 40. Dual-polarized received signals that enter the main port 30*a* of the Y junction device 30 propagate substantially unimpeded along a main waveguide portion of the Y junction device and exit the receive outlet port 30*b* into the receive isolation filter 40. The Y junction device 30 also includes a transmit port 30*c* to which is coupled one end of a transmit waveguide 34. The opposite end of the transmit waveguide 34 is coupled with a transmitter 50 of the antenna. Transmitted signals from the transmitter 50 are propagated along the transmit waveguide 34 into the transmit port 30*c* of the Y junction device 30 and then are propagated substantially unimpeded along a waveguide portion of the Y junction device and out the main port 30*a* to the T/R feed 22, which transmits the signals toward the reflector of the antenna where the signals are reflected back toward a satellite or other destination.

The Y junction device 30 thus is operable to channel transmitted and received signals along separate paths such that transmitted signals from the transmitter are substantially prevented from passing out the receive port into the receive isolation filter 40, and received signals from the T/R feed 22 that enter the main port 30*a* of the Y junction device are substantially prevented from passing through the transmit port 30*c* into the transmit waveguide 34 and thence to the transmitter 50. However, the Y junction device generally cannot be completely effective in this separation of the transmitted and received signals. Accordingly, generally some attenuated transmitted signals will find their way through the receive port 30*b* of the Y junction device. Although these signals may be attenuated relative to their original level, they can still be large in comparison with the levels of received signals. Therefore, filtering of the received signals is required, and is performed by the receive isolation filter 40.

In accordance with the present invention, the received signals are dual-polarized, meaning that they contain two components that are polarized in two different ways. Typically the two components are polarized in two orthogonal planes, and are usually denoted by the terms "vertical" and "horizontal" components. Alternatively, the two components can be right-hand and left-hand circularly polarized. In contrast to prior antenna systems in which the two components are separated and then filtered by two separate filters, the present invention employs the receive isolation filter 40, which filters both components without separating them. The receive isolation filter 40 is operable to filter the signals that pass into its input port such that signals within the frequency band corresponding to the dual-polarized received signals are passed with relatively little attenuation through the output port of the filter and are fed to a further component such as a low noise block (LNB) module 60. However, signals within the frequency band of the transmitted signals from the transmitter 50 are substantially attenuated to a level substantially below that of the received signals.

Figure 5:
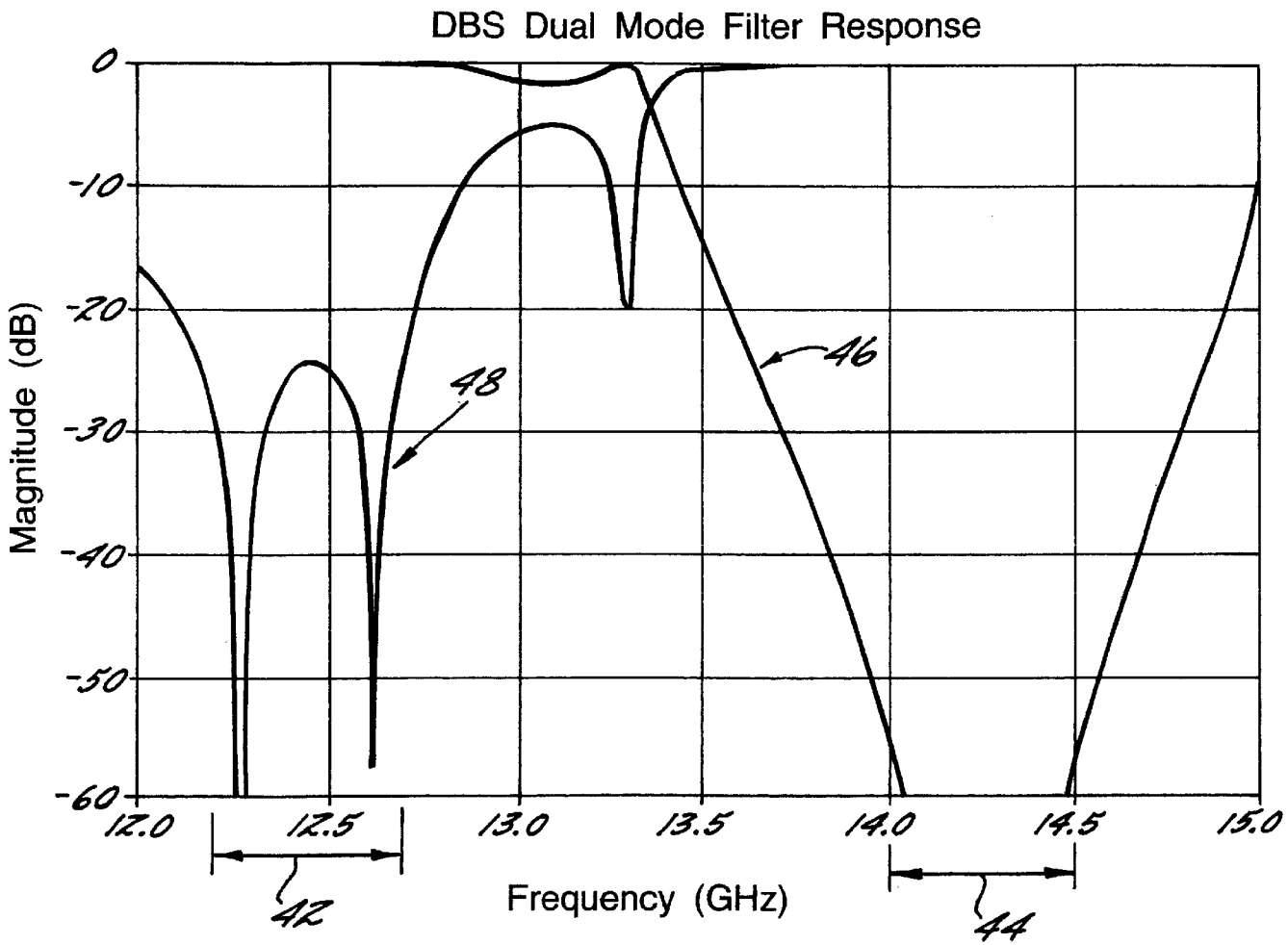
FIG. 5 is a plot of frequency response for the receive isolation filter in accordance with one embodiment of the invention.

FIG. 5 shows an exemplary frequency response plot for a receive isolation filter 40 in accordance with the present invention. In this example, the receive frequency band 42 is about 12.2 to 12.7 gigaHertz and the transmitting frequency band 44 is about 14.0 to 14.5 gigaHertz. The curve 46 represents the isolation of the filter, and exhibits an approximately zero dB isolation in the receive frequency band 42, while providing an attenuation of at least about 60 dB in the transmit frequency band 44. The curve 48 represents the return loss of the filter, and shows a return loss of about 20 dB in the receive frequency range and a return loss of about zero dB in the transmitting frequency range. Of course, the invention is not limited to any particular receive and transmit frequency bands. Those skilled in the art will recognize the frequency ranges referred to above as corresponding to the Ku-band; however, the invention can be used for other frequencies such as the Ka-band in which signals are received in the range of about 19.7 to 20.2 gigaHertz and are transmitted in the range of about 29.5 to 30.0 gigaHertz. To operate in the Ka-band, the configurations of various components of the antenna system would differ somewhat from their configurations in the Ku-band, but the general concepts of the invention would remain the same.

As noted previously, the receive isolation filter 40 comprises a dual-mode filter that filters both polarization components of the received signals without having to separate the components and separately filter them. This is accomplished in accordance with preferred embodiments of the invention by appropriately configuring the internal dimensions of the filter 40 so that the filter operates essentially independent of the polarization of the waves propagating through it. To this end, and with reference to FIG. 4, the filter 40 preferably has an internal waveguide passage 52 that has 90° rotational symmetry about its longitudinal axis. Thus, for example, if the plane on which the sectioned view of FIG. 4 is taken corresponds to the plane of a vertical polarization component of the received signal, the passage 52 is configured such that a plane section through the passage orthogonal to the plane of FIG. 4 and also containing the longitudinal axis of the passage, which would correspond to the plane of a horizontal polarization component, appears substantially identical. Various cross-sectional shapes having such 90° rotational symmetry are possible in accordance with the invention, including circular cylindrical passages, square passages, and others. The 90° rotational symmetry of the waveguide passage allows the filter 40 to act on both polarization components of the received signals in substantially the same manner. The filter works with right-hand and left-hand circularly polarized components as well.

Filtering of the signal is accomplished by configuring the internal waveguide passage 52 as a plurality of sequentially arranged cavities 54, 55, 56, 57, 58 having different volumes. The dimensions of the cavities are selected in accordance with the desired frequency response of the filter. The sizing of the cavities can be performed analytically by computer modeling (e.g., finite element modeling) and/or empirically by trial and error. The cavities 54–58 preferably comprise a series of circular cylindrical cavities arranged coaxially with respect to one another and having different diameters, and more particularly having alternately smaller and larger diameters. The cavities 54, 56, and 58 have relatively larger diameters and relatively shorter axial lengths while the cavities 55 and 57 have relatively smaller diameters and relatively greater axial lengths. Thus, the cavities have alternately smaller and larger length-to-diameter ratios. Advantageously, the cavities are not partitioned from one another with internal partitions as in some prior multi-cavity filters, which often include dielectric partitions having specially shaped waveguide apertures therethrough, and may also include internal probes for exciting certain resonant frequencies. Instead, the waveguide passage 52 comprises a continuous, undivided passage from the entrance to the outlet of the filter.

The filter 40 can be manufactured in various ways. Advantageously, the filter can be investment cast or die cast. Careful optimization of the cavity dimensions and careful fabrication of the mold to close tolerances enable the filter to be cast to its final shape. Hence, there is minimal labor involved in making the filter. Furthermore, the filter does not require tuning screws or the like for fine tuning the response of the filter, as in many prior cavity-type filters.

With reference primarily to FIGS. 2 and 3, the feed 24 in the illustrated embodiment comprises a receive-only feed that receives signals reflected from the reflector 20. The feed 24 advantageously comprises a poly-rod formed of a dielectric material. In the illustrated embodiment, the feed 24 is employed for receiving dual-polarized signals containing both right-hand and left-hand circularly polarized components. Accordingly, a polarizer 40' is employed behind the feed 24. However, in the illustrated embodiment, filtering of the signals propagated by the feed 24 is performed within the associated low noise block 60 connected with the polarizer 40'. Of course, alternatively, the filtering could be performed by another dual-mode filter (not shown) similar in concept to the filter 40 used with the T/R feed 22, in which case the filtered signals from the filter would be fed to the low noise block 60. Of course, the feed 24 could alternatively be designed to receive dual-polarized signals containing both vertical and horizontal polarization components.

As already noted, the antenna 10 can include additional feeds 26, 28, if desired, for communicating with other satellites. Each feed 26, 28 includes associated waveguide elements and can also include filtering elements, which are not described in detail herein for sake of brevity. Of course, one or both of the feeds 26, 28 can employ a dual-mode filter similar to the filter 40 if dual-polarized signals are to be received by the feeds, or can employ more-conventional filters if non-dual-polarized signals are to be received.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. An apparatus for transmitting signals to and receiving signals from a source, comprising:

a transmit/receive feed operable to transmit signals to and receive signals from a source, wherein the received signals comprise simultaneously dual-polarized signals containing two components of different polarizations;

a waveguide assembly coupled with the transmit/receive feed for propagating transmitted and received signals to and from the transmit/receive feed; and a receive isolation filter coupled with the waveguide assembly and operable to filter the dual-polarized received signals without separating the two components thereof and to provide the filtered dual-polarized received signals to a receiver so as to isolate the receiver from signals transmitted by the transmit/receive feed.

2. The apparatus of claim 1, wherein the receive isolation filter defies an internal passage that has 90° rotational symmetry such that two orthogonal cross-sections of the passage each containing a longitudinal axis of the passage are substantially identical to each other.

3. The apparatus of claim 1, wherein the receive isolation filter is operable to filter signals containing two orthogonal linearly polarized components.

4. The apparatus of claim 1, wherein the receive isolation filter is operable to filter signals containing right-hand and left-hand circularly polarized components.

5. The apparatus of claim 1, wherein the receive isolation filter defines multiple internal cavities of different dimensions.

6. The apparatus of claim 5, wherein the receive isolation filter is configured such that the passage thereof is continuous and undivided from the entrance port to the outlet port.

7. The apparatus of claim 5, wherein the cavities are cylindrical.

8. The apparatus of claim 5, wherein the cavities are circular cylindrical.

9. The apparatus of claim 8, wherein the circular cylindrical cavities have alternately smaller and larger diameters.

10. The apparatus of claim 8, wherein the circular cylindrical cavities have alternately smaller and larger length-to-diameter ratios.

11. The apparatus of claim 5, wherein the cavities comprise at least first through fifth cavities, proceeding from an entrance port to an outlet port of the filter.

12. The apparatus of claim 11, wherein the first, third, and fifth cavities have relatively smaller volumes than the second and fourth cavities.

13. The apparatus of claim 1, further comprising a second feed operable to receive from a second source dual-polarized signals containing two components of different polarizations, and a second receive isolation filter operable to filter the dual-polarized received signals from the second feed without separating the two components thereof so as to isolate a receiver from signals transmitted by the transmit/receive feed.

14. The apparatus of claim 1, further comprising a transmitter coupled to a transmit port of the waveguide assembly.

15. The apparatus of claim 1, wherein the waveguide assembly includes an ortho-mode transducer operable to channel received and transmitted signals along separate waveguide portions.

16. The apparatus of claim 1, wherein the waveguide assembly includes a diplexer.

17. The apparatus of claim 1, wherein the waveguide assembly defines a main port for carrying transmitted and received signals to and from the transmit/receive feed, a receive port through which received signals entering the main port are propagated to the receive isolation filter, and a transmit port through which transmitted signals from a transmitter are propagated such that the transmitted signals are then passed through the main port to the transmit/receive feed.

18. An apparatus for transmitting signals to and receiving signals from a source, comprising:

a transmit/receive feed operable to transmit signals to and receive signals from a source, wherein the received signals comprise simultaneously dual-polarized signals containing two components of different polarizations;

a waveguide assembly coupled with the transmit/receive feed for propagating transmitted and received signals to and from the transmit/receive feed; and a receive isolation filter coupled with the waveguide assembly and operable to filter the dual-polarized received signals without separating the two components thereof and to provide the filtered dual-polarized received signals to a receiver so as to isolate the receiver from signals transmitted by the transmit/receive feed, wherein the receive isolation filter comprises a plurality of sequentially arranged cylindrical cavities of different internal diameters.

19. The apparatus of claim 18, wherein the cavities are circular cylindrical.

20. The apparatus of claim 19, wherein the circular cylindrical cavities have alternately smaller and larger diameters.

21. The apparatus of claim 19, wherein the circular cylindrical cavities have alternately smaller and larger length-to-diameter ratios.

22. The apparatus of claim 18, wherein the cavities comprise at least first through fifth cavities, proceeding from an entrance port to an outlet port of the filter.

23. The apparatus of claim 22, wherein the first, third, and fifth cavities have relatively smaller volumes than the second and fourth cavities.

24. The apparatus of claim 18, further comprising a second feed operable to receive from a second source dual-polarized signals containing two components of different polarizations, and a second receive isolation filter operable to filter the dual-polarized received signals from the second feed without separating the two components thereof so as to isolate a receiver from signals transmitted by the transmit/receive feed.

25. A dual-mode filter operable to filter a radio-frequency signal having two different polarization components without separating the components, the filter consisting essentially of a generally tubular structure defining a passage extending therethrough along a central axis of the tubular structure, the passage defining a series of sequentially arranged circular cylindrical cavities on each coaxial with the central axis, the cavities including relatively larger-diameter cavities alternated with relatively smaller-diameter cavities, wherein the larger-diameter cavities have relatively small axial lengths in comparison with the smaller-diameter cavities.

* * * * *

UNITED STATES PATENT AND TRADEMARK OFFICE

CERTIFICATE OF CORRECTION

PATENT NO. : 6,529,098 B2
DATED : March 4, 2003
INVENTOR(S) : Moheb

It is certified that error appears in the above-identified patent and that said Letters Patent is hereby corrected as shown below:

Title page,
Item [56], References Cited, U.S. PATENT DOCUMENTS, "5,459,411" should read -- 5,459,441 --.

Column 7,
Line 14, "defies" should read -- defines --.

Column 8,
Line 56, cancel "on".

Signed and Sealed this

Twenty-ninth Day of July, 2003

JAMES E. ROGAN
*Director of the United States Patent and Trademark Office*